United States Patent [19]

Calenda et al.

[11] Patent Number: 4,689,599

[45] Date of Patent: Aug. 25, 1987

[54] THERMOSTAT

[75] Inventors: Ciro Calenda, Aversa; Giuseppe Notaro, Pomigliano D'Arco, both of Italy; Henry Boulanger, Nicholasville, Ky.

[73] Assignee: Texas Instruments Incorporated, Dallas, Tex.

[21] Appl. No.: 781,180

[22] Filed: Sep. 30, 1985

[30] Foreign Application Priority Data

Jun. 24, 1985 [IT] Italy ..... 48273 A/85

[51] Int. Cl.[4] ..... H01H 37/52

[52] U.S. Cl. ..... 337/365; 337/380; 374/187

[58] Field of Search ..... 337/365, 347, 368, 392, 337/380, 349, 319; 73/740; 374/195

[56] References Cited

U.S. PATENT DOCUMENTS

| | | | |
|---|---|---|---|
| Re. 28,181 | 10/1974 | Harland | 73/740 |
| 3,601,741 | 8/1971 | Holden | 337/368 |
| 4,048,611 | 9/1977 | Kuczynski | 337/365 |
| 4,365,228 | 12/1982 | Rowley | 337/347 |
| 4,551,702 | 11/1985 | Hire | 337/347 |

*Primary Examiner*—Daniel M. Yasich

*Attorney, Agent, or Firm*—James P. McAndrews; John A. Haug; Melvin Sharp

[57] ABSTRACT

A thermostat has a cup-shaped insulating base open at one end, a pair of terminals ultrasonically secured in the bottom of the base precisely locating respective stationary contacts within the base and having portions thereof extending outside the base, a flat metal element carrying movable contacts for engaging the stationary contacts, a flat metal motion transfer element secured to the movable contact element and having an extending portion precisely located adjacent the open end of the cup-shaped base, a spring mounted in the base biasing the movable contact element to engage and interconnect the stationary contacts, a dished thermostat metal element disposed in the open end of the base and movable with snap action in response to selected temperature change to engage and move the extending portion of the motion transfer element to move the movable contact element against the spring bias to disengage the stationary contacts, a thin electrically insulating film disposed over the thermostat metal element, and a lid secured over the open end of the base mounting the thermostat metal element in the open base end, the motion transfer element having a slit therein permitting compression of the extending portion thereof to adjust its spacing from the thermostat element for calibrating the thermostat.

4 Claims, 5 Drawing Figures

THERMOSTAT

BACKGROUND OF THE INVENTION

The present invention relates to a temperature responsive thermostat.

Various thermostats such as the one shown in the commonly assigned, copending application Ser. No. 781,619 filed on even date herewith are well known wherein a dished thermostat metal element is disposed in an open end of a cup-shaped insulating base to move with snap action in response to selected temperature change, stationary contacts are mounted in the base on terminals which extend through the base bottom, a movable contact element is movable to engage and disengage the stationary contacts to open and close an electrical circuit, a spring biases the movable contact element to a closed circuit position, and a motion transfer element moves in response to snap acting movement of the thermostat metal element to move the movable contact element to open the circuit when the selected temperature change occurs.

However, as a result of problems experienced in manufacturing and assembling the components of such thermostats, it is difficult to put them together inexpensively and reliably to provide the thermostat with desired, precisely predetermined temperature response characteristics.

BRIEF SUMMARY OF THE INVENTION

It is an object of this invention to provide a thermostat which is characterized by improved simplicity in the manufacture and assembly of the thermosat components and by the low cost and high reliability of the thermostat for operating at precisely predetermined temperatures.

According to the invention, the above object is achieved by providing a cup-shaped base of an ultrasonically fusible, electrical insulating material having an open ended cavity and having terminal slits formed in the bottom of the cavity. Preferably locating shoulders are formed both inside and outside of the cavity adjacent the terminal slits and a pair of L-shaped strip terminals each having a longer leg with portions of progressively narrow width and scalloped edges are inserted into and ultrasonically sealed within the respective slits. The shorter legs of the terminals carry stationary contacts and are abutted with respective locating shoulders inside the base. The distal ends of the longer legs are then bent against respective locating shoulders outside the base, thereby to precisely and securely locate the stationary contacts within the base on the shorter terminal legs. A spring is mounted in a seat in the base bottom and a flat metal movable contact element, preferably of a magnetic steel material or the like having a central slit therein is provided with a pair of movable contacts thereon and is disposed within the base to engage or disengage the movable contacts with the respective stationary contacts for selectively interconnecting the stationary contacts, the spring preferably biasing the movable contact elements to movably engage the stationary contacts to close an electrical circuit between the terminals. A flat metal motion transfer element has a tab on one edge secured in the movable contact element slit to secure it to the movable contact element, has lateral edge guide portions slidable in respective grooves in the base, and has an opposite edge portion extending toward the open end of the base. A dished thermostat metal element is mounted over the open base end in a selected location relative to the extending portion of the motion transfer element. The motion transfer element preferably has a lateral slit formed therein between the extending edge portion and the tab for permitting adjustment of the spacing between the extending portion of the motion transfer element and movable contact element, thereby to position the extending portion with a selected spacing from the dished bimetallic element when the movable contact element is engaged with the stationary contacts. A thin pliable electrically insulating film is disposed over the thermosat metal element and a cup-shaped, thermally conductive metal lid is secured over the open end of the base for locating the thermostat element on the base.

In that arrangement, it is found that the terminals, the movable contact element, and the motion transfer element as well as the spring, the thermosat metal element, film and lid are all adapted for easy assembly to provide a device with reliable and predetermined thermal response characteristics. The movable contact element and transfer element are adapted for low cost manufacture in a continuous strip and are easily secured together, the resulting subassembly being easily positioned in the base relative to the stationary contacts.

DESCRIPTION OF THE DRAWINGS

Other advantages and features of the present invention appear in the following detail description of preferred embodiments of the invention, the detailed description referring to the drawings in which.

DESCRIPTION OF THE PREFERRED EMBODIMENTS

Figure 1:
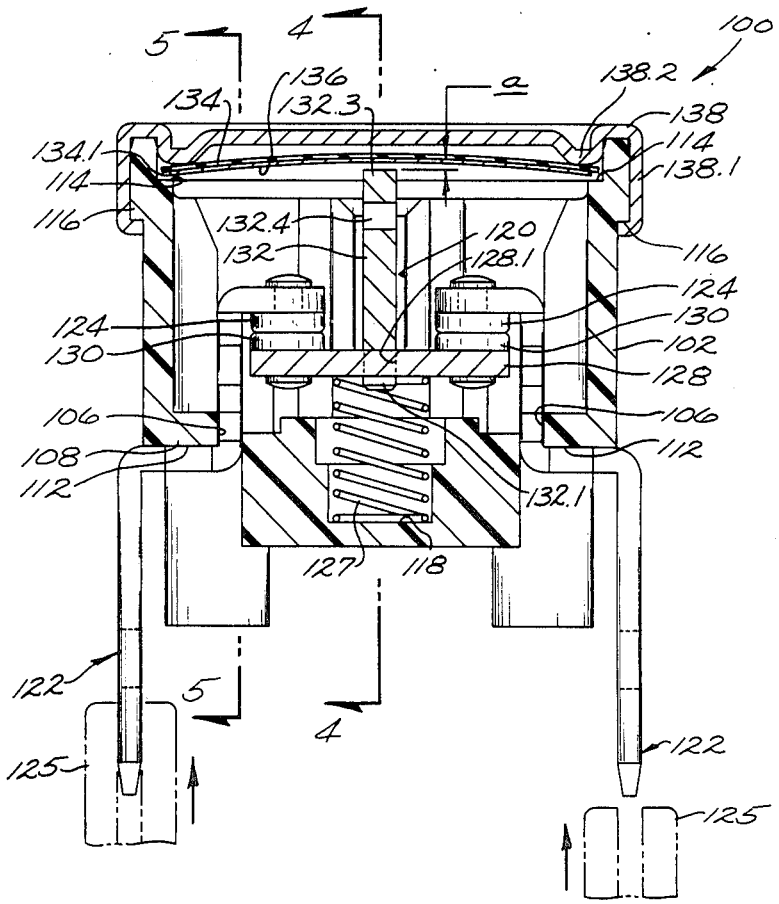
FIG. 1 is a section view along the principal axis of the thermostat of the invention.
Figure 2:
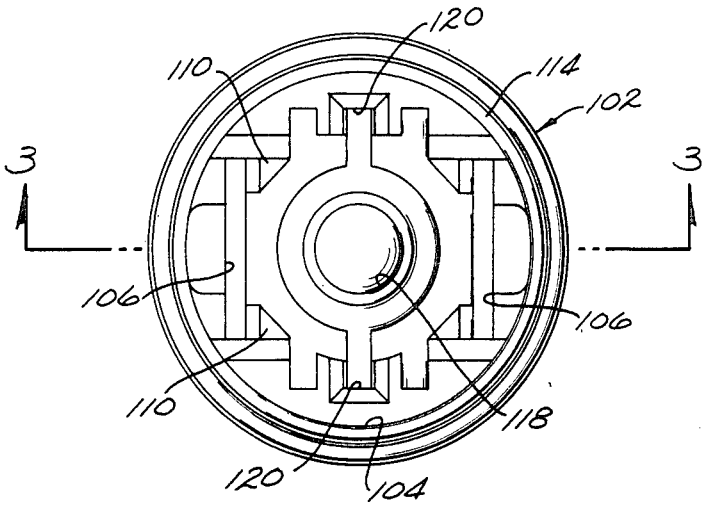
FIG. 2 is a plan view of the base used in the device of FIG. 1.
Figure 3:
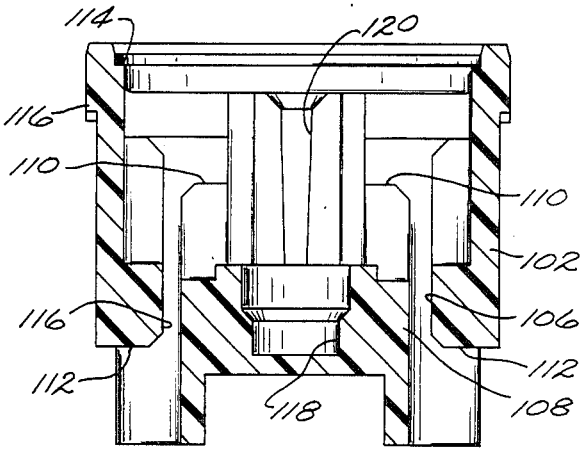
FIG. 3 is a section view along line 3—3 of FIG. 2.

Referring to the drawings, 100 in FIG. 1 indicates the novel and improved thermostat of this invention which is shown to include a generally cylindrical cup-shaped base 102 of a generally rigid, ultrasonically fusible, electrically insulating organic material or the like having a cavity 104 open at one end, having a pair of terminal slits 106 extending through the bottom 108 of the base, having a pair of locating shoulders 110 on the base at each side of the respective terminal slits 106 inside the base cavity (see FIGS. 2–3), having a pair of locating shoulders 112 on the outside of the base adjacent the respective terminal slits 106, having a shoulder 114 extending around the base adjacent the open end of the base cavity, and having a flange part 116 extending around the outer rim of the open base end. A seat 118 is formed in the bottom of the base cavity between the terminal slits 106, and a pair of grooves 120 are provided in the wall of the base cavity at opposite sides of the seat 118.

In accordance with this invention a pair of L-shaped strip terminals 122 are each provided with a plurality of portions 122.1, 122.2 and 122.3 of progressively narrower width in the longer leg 122.4 of the terminal and have scallops or notches 122.5 formed in the edges of that terminal leg. The shorter leg 122.6 of the terminal has a stationary electrical contact 124 secured thereto, preferably by riveting or the like as shown, and, if desired, an opening 122.7 is provided in each terminal to facilitate precise bending of the terminal at the junction of the legs.

Figure 5:
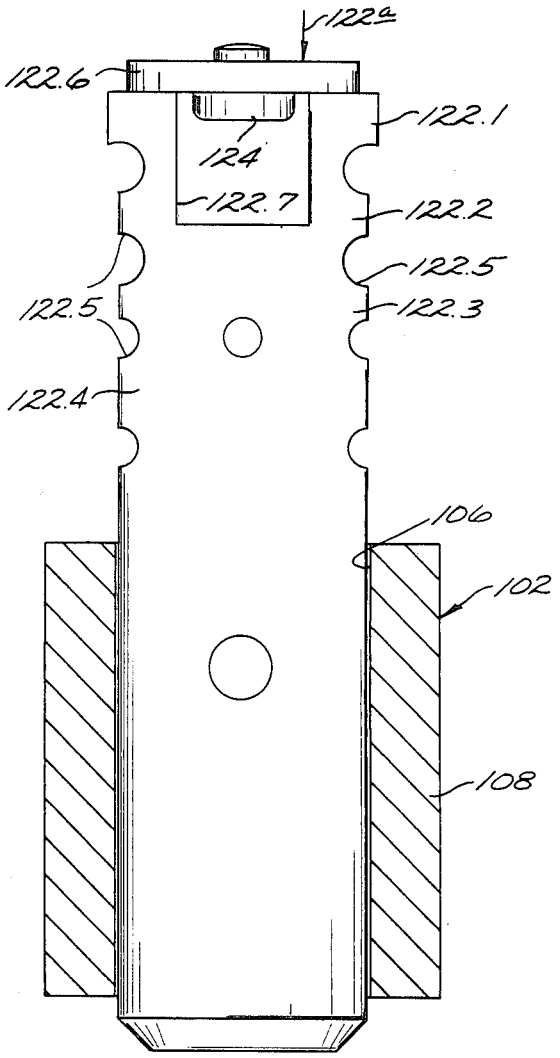
FIG. 5 is a partial section view along line 5—5 of FIG. 1 diagrammatically illustrating a step in the assembly of the device of FIG. 1.

As shown in FIG. 5, each terminal 122 has its longer leg inserted into a terminal slit 106 and pressed into the slit as indicated in FIG. 5 by the arrow 122*a* while ultrasonic energy is applied to the slit area of the base in any conventional manner (not shown) so that the relatively wider strip portions 122.1, 122.2 and 122.3 of the terminal are progressively pushed into a slit 106 and are embedded in the lateral walls of the base adjacent the slit, while the scallops are filed with the ultrasonically fusible base material as will be understood, until respective lateral edges of the shorter base leg 122.6 engage respective locating shoulders 110 on the base, thereby to locate the terminals 122 in the base for precisely positioning the stationary contact 124 as shown in FIG. 1. The distal ends of the longer terminal legs 122.4 are then bent as shown in FIG. 1 to bear against corresponding locating shoulders 114 on the outer side of the base. In that arrangement, pushing of quick connect connectors or the like onto the terminal ends as is diagrammatically illustrated by the broken lines 125 in FIG. 1 in making electrical connection to the terminals does not tend to displace the terminals 122 from their desired assembled position ultrasonically sealed in the slits 106 as will be understood. Preferably the distal terminal ends extend from the thermosat 100 in the direction shown but it will be understood that the terminal ends may be bent in any direction to make desired electrical connection without tending to disturb the seating of the terminals in the base.

In accordance with this invention, a helical coil compression spring 127 is disposed in the base seat 118.

A flat metal movable contact element 128, preferably of a steel or other magnetic, electrically conductive metal meterial has a pair of movable contacts 30 secured thereto, preferably be riveting or the like, in spaced relation to each other to engage the stationary contacts 124 and a slit 128.1 is provided in the movable contact element. In that configuration the movable contact element 128 is adapted to be readily blanked from a strip material in a low cost manufacturing procedure. A flat metal motion transfer element 132 is also adapted to be inexpensively blanked from a strip material with a configuration as shown generally in FIG. 4 wherein a tab 132.1 is located at one edge of the strip material adapted to be inserted into the movable contact element slit 128.1 and to be riveted or expanded therein for securing the motion transfer element in the movable contact element together as is diagrammatically illustrated in FIG. 4. Lateral edges 132.2 of the motion transfer element are proportioned to be slidably received in the respective grooves 120 in the base and an opposite edge of the motion transfer element has an extending portion 132.3. The movable contact element with the attached motion transfer element is then disposed on the spring 127 so that the spring biases the movable contact element into electrical engagement with the stationary contacts 124 for interconnecting the stationary contacts and for disposing the extending portion 132.3 of the motion transfer element at a selected location adjacent the open end of the base 102.

A conventional dished, thermostat metal disc element 134 is disposed with its perimeter 134.1 resting on the base shoulder 114 and a thin pliable film 136 of an electrically insulating material such as a polyimide material or the like sold under the name Kapton is disposed over the thermostat element as shown in FIG. 1. Preferable a magnet is positioned to draw the movable contact element 128 and motion transfer element 132 down into the base cavity 104 against the bias of the spring 118 as shown in the noted copending patent application to facilitate assembly of the disc and film in the thermostat 100. A cup-shaped metal lid 138 is then disposed over the open base end and has its rim 138.1 swaged or otherwise formed over the base flange 116 for securing the lid to the base, the base having an annular ridge 138.2 formed therein to be positioned adjacent the rim 134.1 of the thermostat element, thereby to cooperate with the base shoulder 114 in precisely locating the thermostat element 134 with a selected spacing a relative to the extending portion 132.3 of the motion transfer element.

In the arrangement, the thermostat element 134 is adapted to move to an inverted dished configuration with snap action in conventional manner when the thermostat element is heated to a selected actuating temperature, thereby to engage the extending portion 132.3 of the motion transfer element as will be understood for moving the movable contact element 128 against the bias of the spring 118 to disengage the stationary contacts 124 and open the circuit between the device terminals 122. Then, upon subsequent cooling down to a relatively lower reset temperature, the thermostat element is adapted to return to its original dished configuration as shown in FIG. 1 with snap action for permitting the bias of the spring 118 to reengage the movable contact element with the stationary contacts for reclosing the device circuit. As will be understood, the lid 138 is thermally conductive for readily transmitting heat to the thermosat element 134 from a temperature zone being monitored by the thermostat 100.

Figure 4:
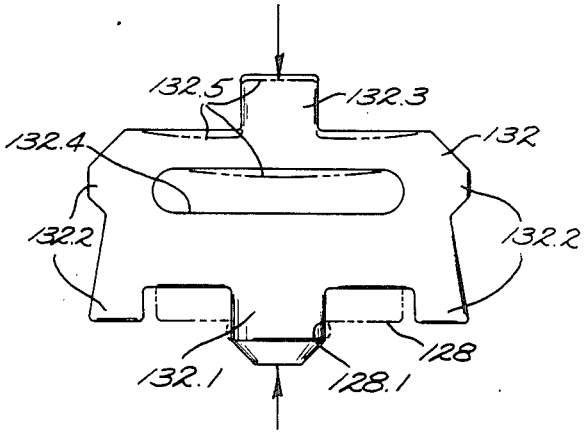
FIG. 4 is a partial section view to enlarged scale along line 4—4 of FIG. 1.

In accordance with this invention, the motion transfer element 132 preferably has a slit 132.4 therein located between the tab 132.1 and the extending portion 132.3 of the element, whereby, when the transfer element is secured together with the movable contact element 128 by pressing in the direction diagrammatically illustrated by the arrows 140 in FIG. 4, the motion transfer element is adapted to be selectively compressed as is diagrammatically illustrated at 132.5 for providing a precise spacing between the movable contact 128 and the extending portion 132.3 of the transfer element. In that arrangement the extending portion 132.3 of the motion transfer element is adapted to be easily and precisely located so it is accurately spaced relative to the thermostat element 134 to permit initial creep action of the thermosat element without causing opening of the thermostat contacts but is then adapted to provide sharp snap acting movement of the movable contact element when the thermostat circuit is to be opened in response to the selected temperature change. In that way, the thermostat 100 is characterized by utilizing low cost, easily manufactured and assembled components and is also characterized by accurate thermal response characteristics as assembled, each thermostat component being individually characterized by low cost manufacture and by ease of assembly and the thermostat as a whole being characterized by reliable and accurate assembly.

It should be understood that although particular embodiments of the thermostat of this invention have been described by way of illustrating the invention, this invention includes all modifications and equivalents of the disclosed embodiments falling within the scope of the appended claims.

We claim:

1. A thermostat having a cup-shaped insulating base with a bottom and with a cavity open at one end, a pair of terminals mounted on the base bottom locating respective stationary contacts inside the cavity and having portions extending from the base outside the base bottom, a movable contact element movable between positions engaging and disengaging the stationary contacts for closing and opening an electrical circuit between the terminals, a dished thermostat metal element mounted on the base at the open base end to be movable with snap action in response to selected temperature change, a lid secured to the base over the open base end for locating the thermostat element, spring means biasing the movable contact element to one of said circuit positions, and a motion transfer element rigidly secured to the movable contact element to be movable with the thermostat metal element for moving the movable contact element to the other circuit position against the spring bias, characterized in that the movable contact element comprises a flat metal sheet element having a slit therein, the motion transfer element comprises a flat metal sheet element having a tab at one edge secured within said movable contact element slit for securing the motion transfer element to the movable contact element and having an opposite edge portion extending from the element to be engaged by the thermostat metal element, the motion transfer element further having lateral edge parts thereof extending to be slidably engaged with the base for guiding movement of the movable contact element between said open and closed circuit position, said thermostat further characterized in that the motion transfer element has a spacing slit therein between said tab and said extending portion thereof so that the motion transfer element is compressible into the spacing slit for precisely positioning the extending portion thereof relative to the movable contact element secured thereto by the tab, thereby providing precise spacing between said movable contact element and said extending portion.

2. A thermostat as set forth in claim 1 further characterized in that a thin electrically insulating film is secured over the thermostat metal element between the thermostat metal element and the lid for electrically isolating the thermostat metal contacts from the lid.

3. A thermostat as set forth in claim 2 further characterized in that the base has grooves therein at respective opposite sides of the base cavity and the motion transfer element has lateral edges thereof slidable in said respective grooves for guiding movement of the movable contact element between said open and closed circuit positions.

4. A thermostat having a cup-shaped insulating base with a bottom and with a cavity open at one end, a pair of terminals mounted on the base bottom locating respective stationary contacts inside the cavity and having portions extending from the base outside the base bottom, a movable contact element movable between positions engaging and disengaging the stationary contacts for closing and opening an electrical circuit between the terminals, a dished thermostat metal element mounted on the base at the open base end to be movable with snap action in response to selected temperature change, a lid secured to the base over the open base end for locating the thermostat element, spring means biasing the movable contact element to one of said circuit positons, and a motion transfer element secured to the movable contact element to be movable with the thermostat metal element for moving the movable contact element to the other circuit position against the spring bias, characterized in that the movable contact element comprises a flat metal sheet element having a slit therein, the motion transfer element comprises a flat metal element having a tab at one edge secured within said slit for securing the motion transfer element to the movable contact element and having an opposite edge portion extending from the element to be engaged by the thermostat metal element, the motion transfer element having lateral edge parts slidably engaged with the base for guiding movement of the movable contact element between said open and closed circuit positions and in that the base has a pair of slits in the base bottom, has locating shoulder means inside the base adjacent respective terminal slits and has locating shoulder means on the outside of the base adjacent the respective terminal slits, each terminal comprises an L-shaped terminal member having a longer leg and a shorter leg, having a stationary contact secured to the shorter leg, and having a plurality of sections of the longer leg of progressively narrower width scalloped along lateral edges thereof, and the longer terminals legs are inserted into and ultrasonically sealed in the respective terminal slits in the base bottom with the shorter terminal legs abutted with locating shoulder means inside the base cavity, the longer terminal legs being further bent outside the base into engagement with said respected locating shoulder means outside the base, thereby to positively receive the terminals in the desired position in the base bottom and to retain the terminals therein even when subjected to axially applied forces while interconnecting the terminals in an electrical circuit.

* * * * *